US007629980B2

(12) United States Patent
Chuang

(10) Patent No.: US 7,629,980 B2
(45) Date of Patent: Dec. 8, 2009

(54) COLOR-REVEALING METHOD, COLOR-CHANGING METHOD AND COLOR-PROCESSING DEVICE

(75) Inventor: Cheng-Wei Chuang, Taipei (TW)

(73) Assignee: Via Technologies, Inc., Taipei (TW)

( * ) Notice: Subject to any disclaimer, the term of this patent is extended or adjusted under 35 U.S.C. 154(b) by 357 days.

(21) Appl. No.: 11/552,863

(22) Filed: Oct. 25, 2006

(65) Prior Publication Data

US 2008/0030517 A1 Feb. 7, 2008

(30) Foreign Application Priority Data

Aug. 3, 2006 (TW) ..... 95128547 A

(51) Int. Cl.
*G09G 5/02* (2006.01)

(52) U.S. Cl. ..... 345/589; 345/950; 345/593; 345/595; 345/600; 345/602; 382/162; 382/167

(58) Field of Classification Search ..... 345/595
See application file for complete search history.

(56) References Cited

U.S. PATENT DOCUMENTS 5,204,664 A * 4/1993 Hamakawa ..... 345/602
5,384,902 A * 1/1995 Carlsen ..... 345/593
5,990,912 A * 11/1999 Swanson ..... 345/568
6,008,816 A * 12/1999 Eisler et al. ..... 345/589
7,038,696 B2 * 5/2006 Emerson et al. ..... 345/600

* cited by examiner

*Primary Examiner*—Antonio A Caschera
(74) *Attorney, Agent, or Firm*—Kirton & McConkie; Evan R. Witt

(57) ABSTRACT

A method is used for changing colors of a first image frame to form a second image frame. Palette index values of the first image frame are first read. Then, color change index values specific to the second image frame and correlating to the palette index values are read respectively via a color change index array. Afterwards, color value sets corresponding to the color change index values are read respectively. Consequently, the second image frame is displayed with colors indicated by the color value sets.

5 Claims, 5 Drawing Sheets

COLOR-REVEALING METHOD, COLOR-CHANGING METHOD AND COLOR-PROCESSING DEVICE

FIELD OF THE INVENTION

The present invention relates to a color-revealing method, and more particularly to a color-revealing method for displaying an image frame with pre-defined colors. The present invention also relates to a color-changing method for changing colors of an image frame, and a color-processing device for revealing colors and/or changing colors of an image frame.

BACKGROUND OF THE INVENTION

With the development of digital world, multimedia with better and better visual effects has been highly advanced. Research and development in image and video technologies are also valued by many industrial corporations in order to enrich the color effects.

Referring to FIG. 1, conventional means for displaying image is illustrated. As shown, an image frame generally includes several image zones such as image zone A, image zone B, image zone C and image zone D. Each image zone consists of a plurality of pixels. For revealing colors of the image frame, an index value I is imparted to each pixel in the image frame so that the color values of the image frame can be realized by corresponding to each of the index values to one of the color value set in a palette array P. Accordingly, the color values of all the pixels reveal the color effect of the image frame. Each color value set includes a red color value R, a green color value G and a blue color value B, which are differentially mixed to show different colors indicated by different index values. For example, when a display exhibits a 16-color display mode, it means 16 kinds of index values are provided. Meanwhile, each index should be expressed by at least 4 bits in order to indicate 16 colors.

Give the image zone C as an example. Assume the index value of the pixels in the image zone C is 15. Then, a color value set (x, y, z) in the palette array P is pointed by the index value 15. Accordingly, the red, green and blue colors are adequately mixed to show the desired color.

Generally, patterns and colors of image frames are previously defined and stored. When there is any pattern or color change involved between frames, patterns and colors of both of the frames need to be stored in the memory pixel by pixel. In other words, the index values of all the pixels of the image frame need to be stored to show the color change. For example, when a color of a pixel changes from yellow to red, both the index value pointing to the yellow color and the index value pointing to the red color are stored in the memory so that the yellow and red color values can be displayed according to the stored index values in order to show the color change from yellow to red.

Thus, a large quantity of index values associated with sequentially changing frames need to be stored, and the quantity of data to be stored further increases with the image or video color effects. Therefore, a large capacity of memory is disadvantageously required. For example, for displaying a 640×480 image frame in a 16-color display mode, 640×480 index values need be stored, and thus the total bit number for storing one image frame will be as high as 640×480×4, i.e. 1,228,800 bits. Accordingly, once color change of the image frame occurs, double the amount 1,228,800 bits will need to be stored. It is apparent that a large storage space is required and then the cost would be high, especially in cost-oriented industries including DVD production.

SUMMARY OF THE INVENTION

A method for revealing a color of a pixel of an image frame is provided. First, a palette index value of the pixel is read. A color change index value corresponding to the palette index value of the pixel is read. A color value set corresponding to the color change index value is read. Finally the pixel with a color indicated by the color value set is displayed.

A method for changing colors of a first image frame to form a second image frame is provided. Palette index values of the first image frame are read. Color change index values specific to the second image frame and correlating to the palette index values are read respectively via a color change index array. Color value sets corresponding to the color change index values are read respectively. The second image frame is displayed with colors indicated by the color value sets.

A color-processing device is provided. The device includes a storage device for storing at least one palette index value, at least one color change index array and a palette array; and a micro-processor coupled to the storage device for reading the palette index value, corresponding the palette index value to a color change index value of an element in the color change index array, and corresponding the color change index value to a color value set in the palette array, thereby revealing the color indicated by the color value set.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF THE PREFERRED EMBODIMENT

Figure 1:
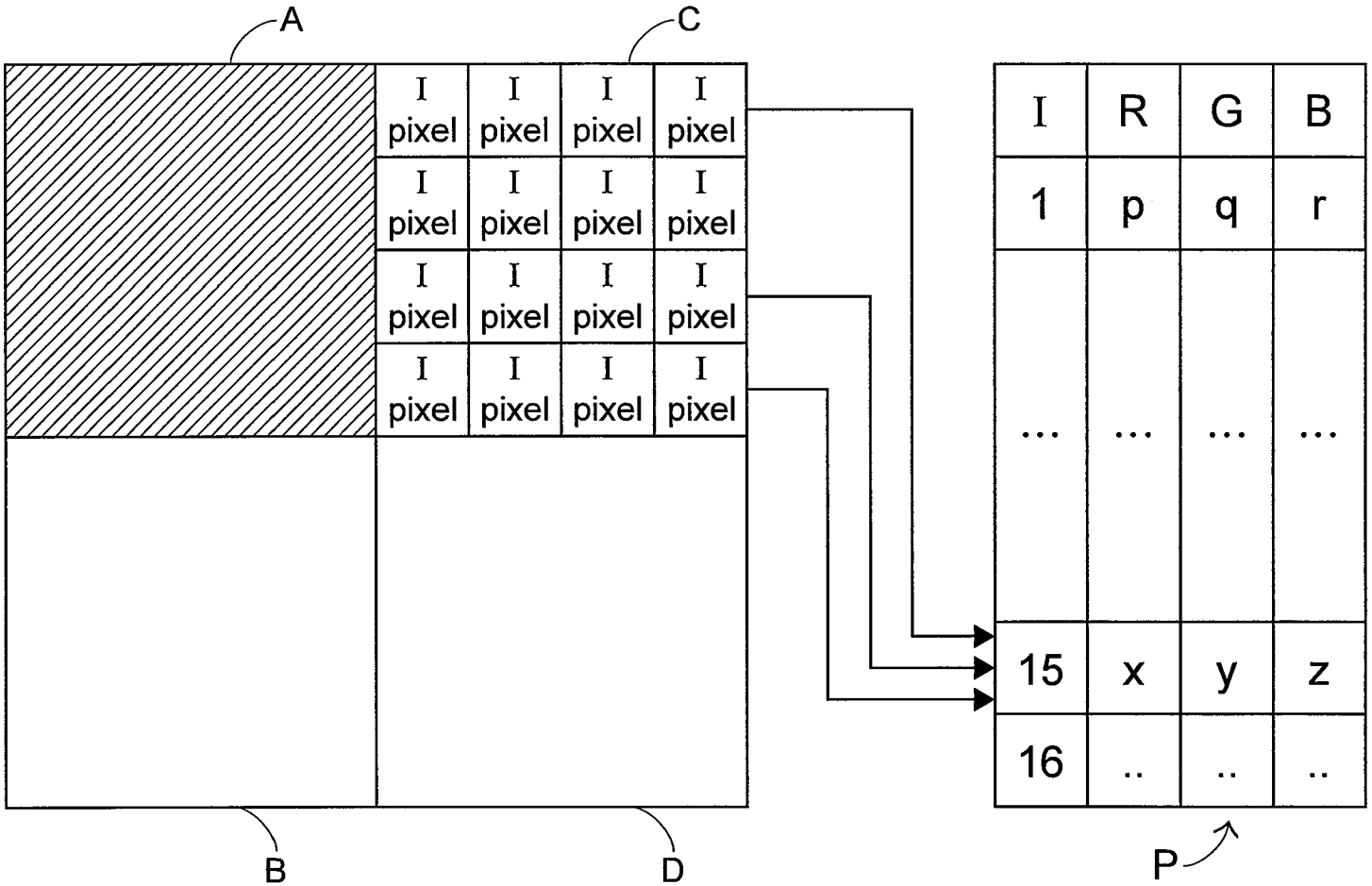
Fig.1 PRIOR ART
FIG. 1 is a schematic diagram illustrating how the colors of portions of an image frame are defined according to index values of pixels and a palette array.
Figure 2:
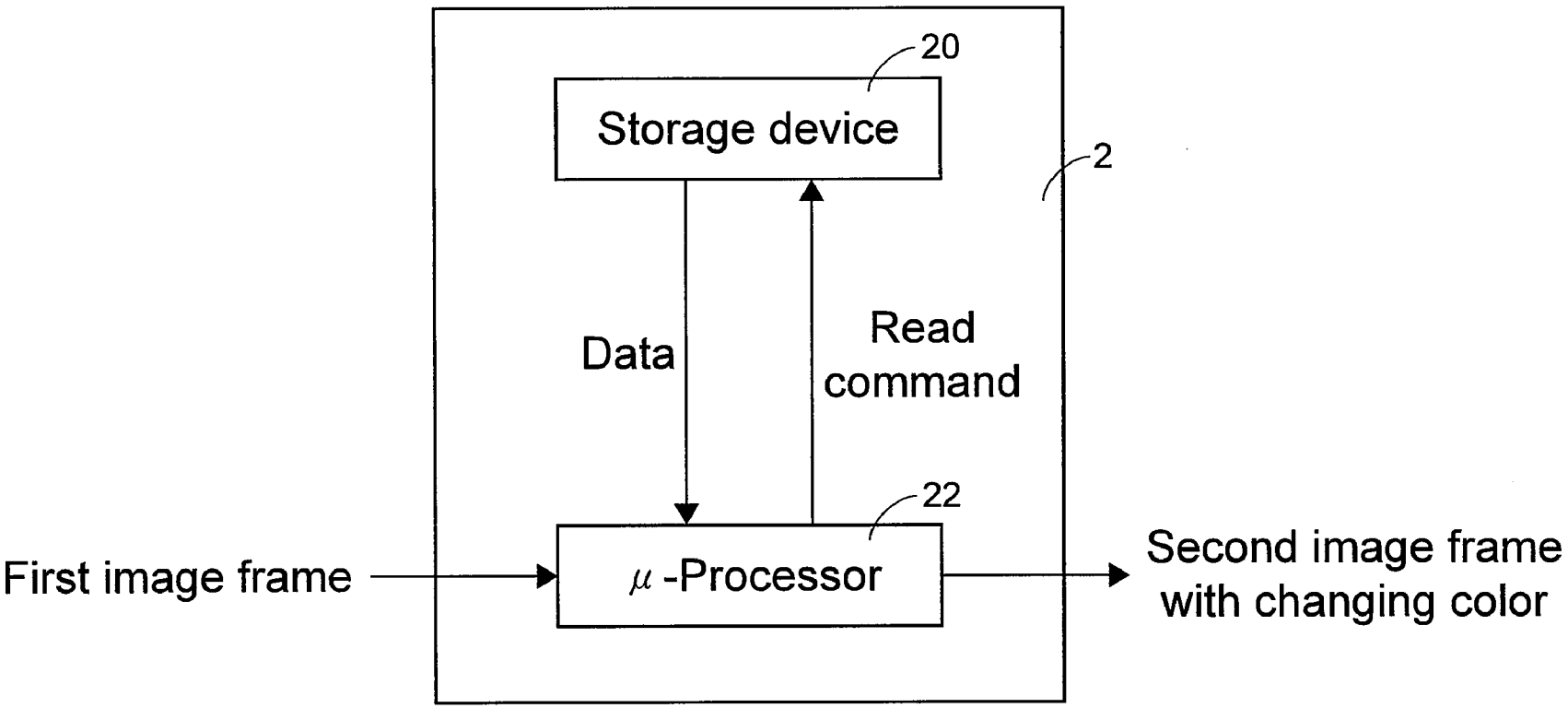
FIG. 2 is a functional block diagram illustrating a color-processing device according to an embodiment of the present invention.

Please refer to FIG. 2, in which an image color converter 2 according to an embodiment of the present invention is shown. The image color converter 2 includes a storage device 20 and a microprocessor 22. The storage device 20 is used for storing palette index values, color change index arrays and a palette array. The microprocessor 22 is coupled to the storage device 20 for reading data required for color change. The storage device 20, for example, can be a read-only memory (ROM), a flash memory or any other suitable memory device. The microprocessor 22 can be a central processing unit (CPU), a digital signal processor (DSP) or any other suitable digital processor.

When color change of a pixel is processed, a palette index value of the pixel is read by the microprocessor 22 from the storage device 20. According to one of the color change index arrays that record color change information upon switching frames. A color change index value corresponding to the palette index value is then read by the microprocessor 22 from the storage device 20. The color change index value corresponds to a color value set in the palette array, thereby revealing the color of the pixel in the current image frame. Afterwards, when another color change of the same pixel is involved between image frames, a color change index value is read by the microprocessor 22 in another color change index array specified to next color-changing frame. The color change index value is obtained according to the same palette index value but different color change index array. Likewise, the color change index value corresponds to a color value set in the palette array, thereby revealing the change color of the pixel in the image frame. It is to be understood that no matter how the color of the pixel changes, the palette index value of the same pixel remains unchanged. Instead, the color change index arrays to be corresponded by the palette index value vary with the frames. The newly realized color change index value in the selected color change index array then reflects the desired color by referring to the palette array.

Figure 3:
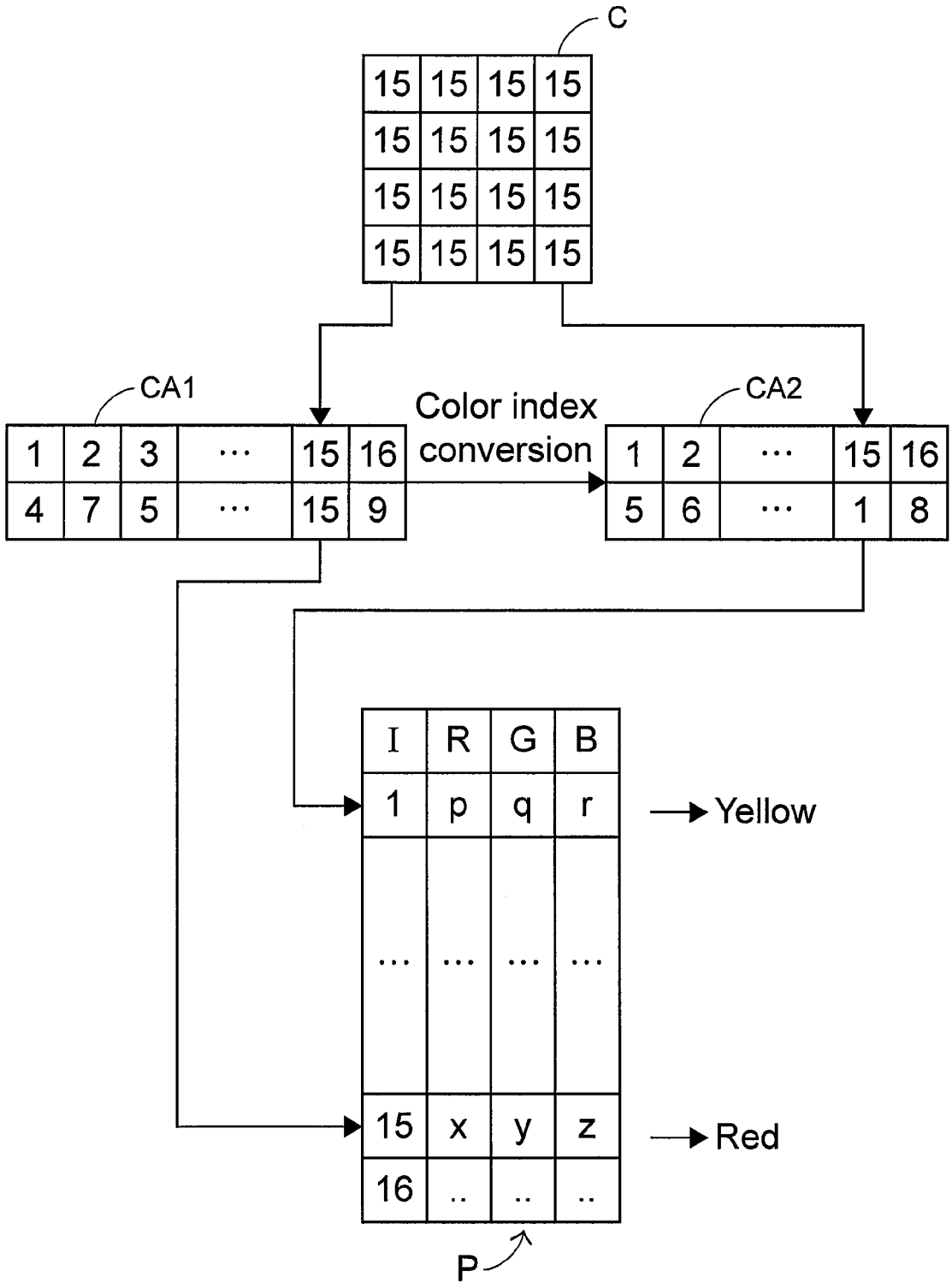
FIG. 3 is a schematic diagram illustrating how the color of an image zone is defined and changed according to a palette index value, a color change index array and a palette array.

An example will be given with reference to FIG. 3. Assume the palette index value of the image zone C stored in the storage device is 15. When a certain frame change from a first frame is changed to a second frame, the adapted color change index array will be changed from the color change index array CA1 to another color change index array CA2, as shown in FIG. 3. As the color change index value corresponding to the palette index value "15" is "15" in the color change index array CA1 but is "1" in the color change index array CA2, the color value sets pointed by the color change index values "15" and "1" are (x, y, z) and (p, q, r) respectively. In the other word, the color of the image zone C is changed from the mixed color indicated by (x, y, z), e.g. red, to another mixed color indicated by (p, q, r), e.g. yellow, when the frame is changed from the first frame to the second frame.

As described above, an element with a color change index value in a color change index array will point to a color value set in a palette array, which reveals a specified color. Therefore, the element number in each color change index array should be able to cover all the colors of the image frame, and all the colors possibly to be displayed, and the bit number of each element should be great enough to differentiate all such colors. For example, for a 16-color image frame or image display, the number of elements in a color change index array should be no less than 16, and the bit number of each color change index value is at least four bits to make 16 kinds of different expressions. Nevertheless, for a 640×480 image frame to be displayed in a 16-color mode, it is not necessary to store the amount of 640×480×4=1,228,800 bits of data for displaying next image frame with changing color. Instead, only 4 (bits/element)×16 (elements)=64 bits of data need to be stored for each color-changing frame. Therefore, the memory space can be largely saved.

Figure 4:
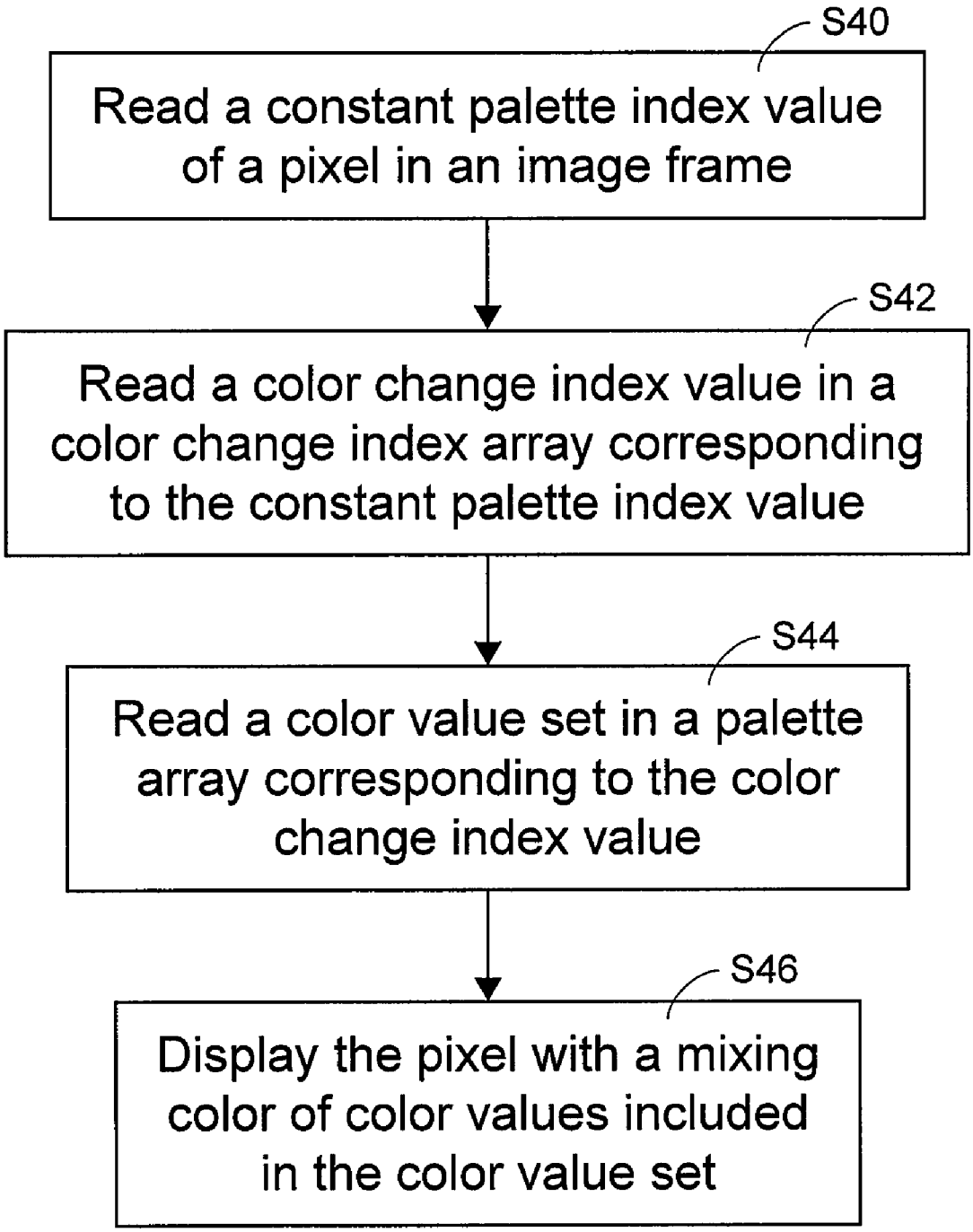
FIG. 4 is a flowchart illustrating a color-revealing method according to an embodiment of the present invention.

The flowchart of FIG. 4 illustrates a color revealing method according to an embodiment of the present invention. First of all, a palette index value of a pixel in an image frame is read (Step S40). According to the palette index value, an element corresponding to the constant palette index value of a pixel is found from a color change index array, and a color change index value of the element is read (Step S42). Then, a color value set can be read with the pointing of the color change index value to a corresponding content in a palette array (Step S44). The color of the pixel to be displayed is the mixed color of the color values included in the color value set (Step S46).

Figure 5:
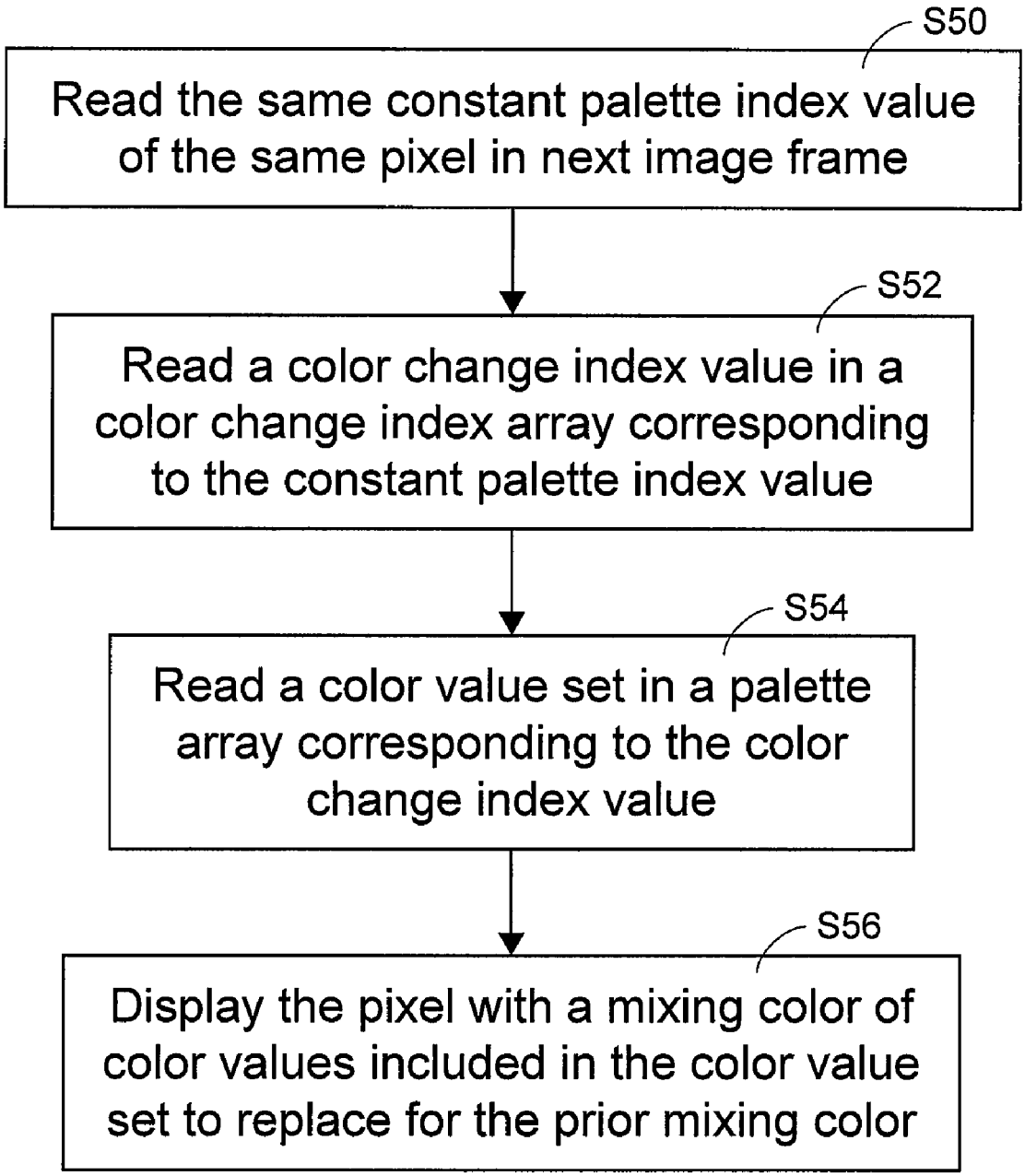
FIG. 5 is a flowchart illustrating a color-changing method according to an embodiment of the present invention.

When color changes to form next image frame, the pixel changes its color based on a palette index value, which is constant for the same pixel, and another color change index array varying with the changing colors, as illustrated in the flowchart of FIG. 5. In the method of FIG. 5, the same palette index value of the same pixel in next image frame is read (Step S50). According to the constant palette index value, an element corresponding to the palette index value is found from another color change index array, and a color change index value of the element is read (Step S52). Then, a color value set can be read with the pointing of the color change index value to a corresponding content in a palette array (Step S54). The color of the pixel to be displayed becomes the mixed color of the color values included in the color value set, and the displayed color is changed (Step S56).

In the above embodiment, a plurality of color change index arrays are stored in the storage device for revealing colors of pixels of different image frames. Therefore, for revealing the color of a specified pixel of a specified image frame, the color change index array corresponding to the specified image frame is referred to. Alternatively, a color change index array can be stored in the storage device for revealing colors of pixels of an image frame. When the image frame is switched to next one, the color change index values of the elements in the color change index array are updated, and the updated color change index value corresponding to the palette index value of the specified pixel is read to show the color change of that pixel.

Conclusively, in the color changing method according to the present invention, the same pixel in color-changing image frames is imparted to the same palette index value, and then the same palette index value is converted into various color change index values depending on image frames. Therefore, it is not necessary to store all kinds of palette index values for all the color-changing image frames. On the other hand, the stored color change index array or arrays are much smaller in size. Accordingly, the memory space can be largely saved.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A color-processing device, comprising:

a storage device for storing a palette index value of a pixel, a first color change index array, a second color change index array, and a palette array; and a micro-processor coupled to the storage device for reading the palette index value, corresponding the palette index value to a first color change index value in the first color change index array and corresponding the first color change index value to a first color value set in the palette array while displaying a first image frame with a color of the pixel indicated by the first color value set, and further corresponding the palette index value to a second color change index value in the second color change index array and corresponding the second color change index value to a second color value set in the palette array while displaying a second image frame with a color of the pixel indicated by the second color value set;

wherein the first color change index value is selected from the first color change index array consisting of a number of first color change index values, the second color change index value is selected from the second color change index array consisting of a number of second color change index values, and each of the number of the first color change index values and the number of the second color change index values corresponds to a number of colors selectable to be revealed.

2. The color-processing device according to claim 1 wherein the first color change index away is updated with the second color change index array by the micro-processor when color change occurs.

3. The color-processing device according to claim 1 wherein the palette index value is a pre-defined constant and unchanged in different image frames.

4. The color-processing device according to claim 1 wherein the number of the first color change index values in the first color change index array is no less than a number of colors of the first image frame, and the number of the second color change index values is no less than a number of colors of the second image frame.

5. The color-processing device according to claim 1 wherein a bit number of the first color change index value renders a maximum value no less than the number of colors of the first image frame, and a bit number of the second color change index value renders a maximum value no less than a number of colors of the second image frame.

* * * * *

UNITED STATES PATENT AND TRADEMARK OFFICE

CERTIFICATE OF CORRECTION

PATENT NO. : 7,629,980 B2
APPLICATION NO. : 11/552863
DATED : December 8, 2009
INVENTOR(S) : Cheng-Wei Chuang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 401 days.

Signed and Sealed this

Second Day of November, 2010

David J. Kappos

David J. Kappos
*Director of the United States Patent and Trademark Office*